US005578891A

United States Patent [19]

Sakai et al.

[11] Patent Number: 5,578,891

[45] Date of Patent: Nov. 26, 1996

[54] ELECTRON MULTIPLIER

[75] Inventors: Shiro Sakai; Takehisa Okamoto; Makoto Nakamura, all of Hamamatsu, Japan

[73] Assignee: Hamamatsu Photonics K.K., Hamamatsu, Japan

[21] Appl. No.: 457,174

[22] Filed: Jun. 1, 1995

Related U.S. Application Data

[63] Continuation of Ser. No. 63,560, May 19, 1993, abandoned.

[30] Foreign Application Priority Data

May 20, 1992 [JP] Japan ..... 4-127690

[51] Int. Cl.[6] ..... H01J 43/18

[52] U.S. Cl. ..... 313/103 R; 313/533; 313/536; 313/105 R; 250/207

[58] Field of Search ..... 313/103 R, 105 R, 313/104, 536, 533, 535; 250/207, 214 VT; 315/201, 205, 341

[56] References Cited

U.S. PATENT DOCUMENTS

| | | | |
|---|---|---|---|
| 2,207,355 | 7/1940 | Shockley | 313/536 |
| 3,229,143 | 1/1966 | Bartschat | 313/103 R |
| 3,272,984 | 9/1966 | Herzog et al. . | |
| 4,125,793 | 11/1978 | Timan | 313/536 |
| 4,370,585 | 1/1983 | Butterwick | 313/536 |
| 4,570,102 | 2/1986 | McDonie et al. | 313/533 |
| 4,575,657 | 3/1986 | Kaiser | 313/533 |
| 4,577,137 | 3/1986 | Kaiser | 313/533 |
| 4,668,890 | 5/1987 | Swingler . | |
| 4,825,066 | 4/1989 | Nakamura et al. | 250/207 |
| 5,051,572 | 9/1991 | Joseph et al. | 250/207 |

FOREIGN PATENT DOCUMENTS

| | | | |
|---|---|---|---|
| 905762 | 7/1949 | Germany | 313/105 R |
| 2291654 | 12/1990 | Japan | 313/103 R |
| 2050048 | 12/1980 | United Kingdom . | |
| 2113000 | 7/1983 | United Kingdom | 313/105 R |

*Primary Examiner*—Sandra L. O'Shea
*Assistant Examiner*—Matthew J. Esserman
*Attorney, Agent, or Firm*—Cushman Darby & Cushman, L.L.P.

[57] ABSTRACT

An electron multiplier according to this invention comprises dynodes DY1 ~DY16 arranged in multi-stages along a direction of incidence of an energy beam for, upon incidence of the energy beam, gradually multiplying secondary electrons to emit the same, a collection electrode A for receiving electrons emitted from that of the dynodes on a last stage, and resistors R1 ~R16 inserted between the respective dynodes and their adjacent ones, the dynodes, the collecting electrode, and the resistors being mounted between two support plates 10*a*, 10*b* disposed in parallel with each other, the resistors being arranged in two rows which sandwich the dynodes.

9 Claims, 8 Drawing Sheets

ELECTRON MULTIPLIER

This is a continuation of Application No. 08/063,560, filed on May 19, 1993, which was abandoned upon the filing hereof.

BACKGROUND OF THE INVENTION

1. Field of the Invention

This invention relates to an ion (electron) multiplier for detecting or measuring energy beams of electrons, ions, charge particles, ultraviolet rays, soft X-rays, etc.

2. Related Background Art

As schematically shown in FIG. 1, in an electron multiplier, energy beams, as of electrons or others, impinge on dynodes DY1~DY16 of the electron multiplying unit to multiply and emit secondary electrons, and the collecting electrodes (anodes) A collect the emitted secondary electrons for detection.

The electron multiplying units have various types. Commonly quarter-cylindrical dynodes DY1~DY16 are substantially alternately arranged in a direction of incidence of energy beams. The arrangement of FIG. 1 is the typical one which is the so-called box-and-grid-type.

Resistors are inserted between the respective dynodes and their adjacent ones. The resistors equidivide a voltage applied between the first-stage dynode DY1 and the final-stage dynode DY16.

This is the basic structure of the electron multipliers. The common assembly of the electron multipliers is shown in FIGS. 2 and 3.

In the electron multiplier of FIGS. 2 and 3, respective dynodes DY are supported, enclosed by respective support frames 1. Each support frame 1 is made of a conducting material and is electrically connected to the associated dynode DY. The electron multiplier further comprises two support rods 3 which are secured to a holder 2 and are parallel with each other. These support rods 3 are inserted in holes 4 of each support frame 1 to support the dynodes by the support rods 3. A gap between each support frame 1 and its adjacent one is retained constant by spacers 5 through which the support rods 3 are inserted.

In this conventional electron multiplier, resistors R are disposed in one row on one of the rows of the dynodes. Leads L of each resistor R are welded respectively to vertically adjacent ones of the support frames 1.

The above-described electron multiplier includes the resistors R arranged in one row on one of the rows of dynodes. This tends to increase a total length of the electron multiplier. To reduce the total length, it is necessary to narrow a gap between the respective resistors and their adjacent ones. But it could adversely cause contact of the leads L of the resistors R to narrow the gap.

The resistors R are supported only by welds of the forward ends of the leads L, which cannot firmly secure the resistors R. It is also a problem that the resistors R totter.

SUMMARY OF THE INVENTION

In view of these problems, this invention has been made, and an object of this invention is to provide an electron multiplier which has a firm structure.

It is another object of the present invention to realize a compact electron multiplier by forming an electron multiplying unit having a shortened total length.

In the preferred embodiment, the electron multiplier according to the present invention comprises: a plurality of dynodes arranged in multi-stages, each dynode facing the dynode of the later stage and each dynode and the plural dynodes constructing an electron multiplying unit for sequencially multiplying an energy incident thereto; a plurality of resistances for applying a predetermined potential between the dynodes which are continuously arranged on each other; and a pair of support plates arranged on both sides of the dynodes and each resistance for supporting the dynodes and resistances on the both sides thereof, the supporting plate being made of insulating material.

In the above-arrangement, it is preferrable to arrange each resistance on a back side of the dynodes which are faced to each other along an arrangement direction of the dynodes and in two rows.

Further, in the above-arrangement, the pair of supporting plates may have a recess extending from an edge of the plate to inner direction therefrom, the recesses may be disposed on a position corresponding to the position at which each resister should be supported, and each resistor may be fixed to the supporting plate by engagement of leads connected to the both sides of each resistor to each recess.

Further, in the above-arrangement, the two-rows of arranged resistors may be alternatively arranged according to the order of the application of a electrical potential difference between the dynodes.

Further, in the above-arrangement, the plural dynodes constructing the electron multiplying unit may be disposed in a different pattern in the upstream and downstream direction of the flow of the multiplied secondary electrons, the dynodes located on the upstream side are arranged in a box-and-grid-type, and the dynodes located on the downstream side are arranged in a line-focus type or a linear-focus type.

Further, in the arrangement, the resistors arranged in the two lines corresponding to the dynodes located in the downstream may be alternatively arranged according to the order of the application of potential difference to the dynodes.

Further, in the above-arrangement, each of the dynodes may have tabs on the both edges thereof, a slot into which the tabs of the dynodes should be inserted is formed at position corresponding to each of the supporting plates, each of the dynodes is fixed to the pair of supporting plates by inserting the tabs into the slot of the supporting plate to engage them each other.

It is preferable that the respective resistors are mounted by inserting the leads of the resistors in recesses formed in the edges of the support plates.

In the present invention, the resistors are divided and arranged in two rows. In comparison with the arrangement of the resistors in one row, a total length of the electron multiplier is shortened.

The dynodes, the collecting electrode and the resistors are supported by two support plates. In comparison with their support by two support rods, the assembly has much improved strength.

The insertion of the leads of the resistors prohibits the displacement of the leads themselves, and the resistors themselves.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
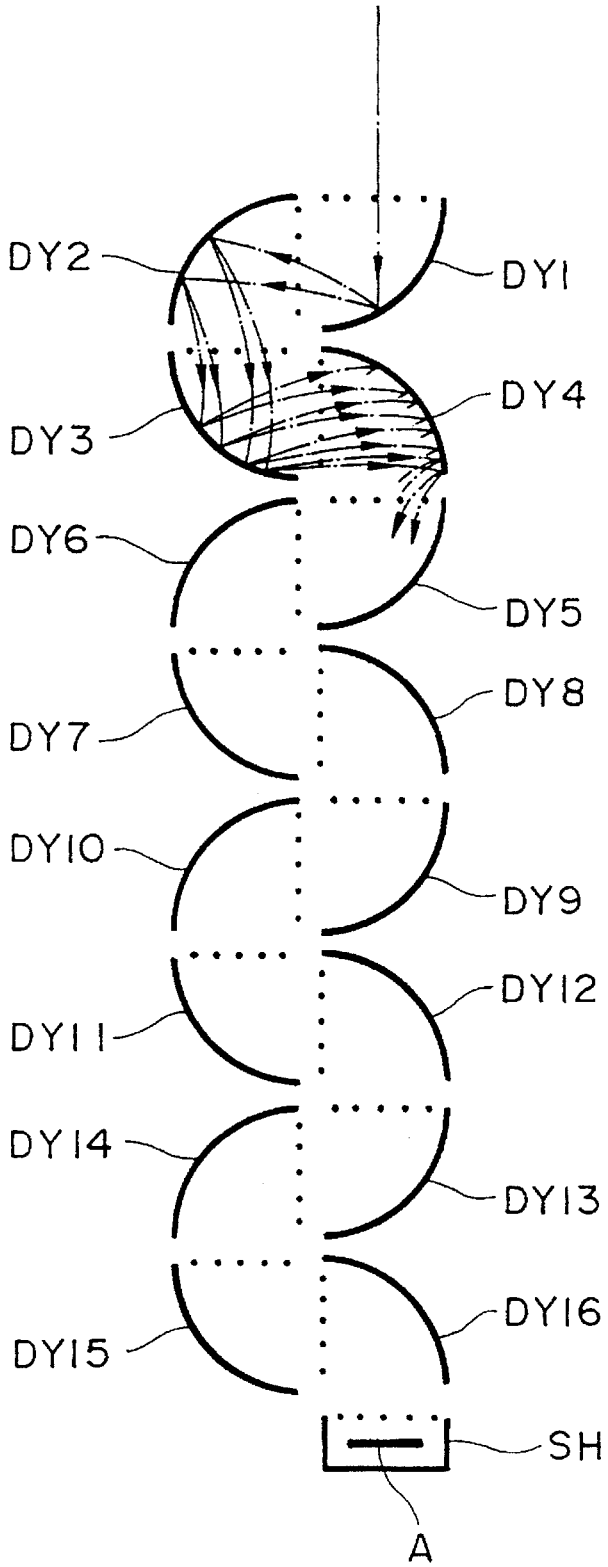
Fig. 1 (PRIOR ART)
FIG. 1 is a schematic view explaining the principle of the electron multiplier.
Figure 2:
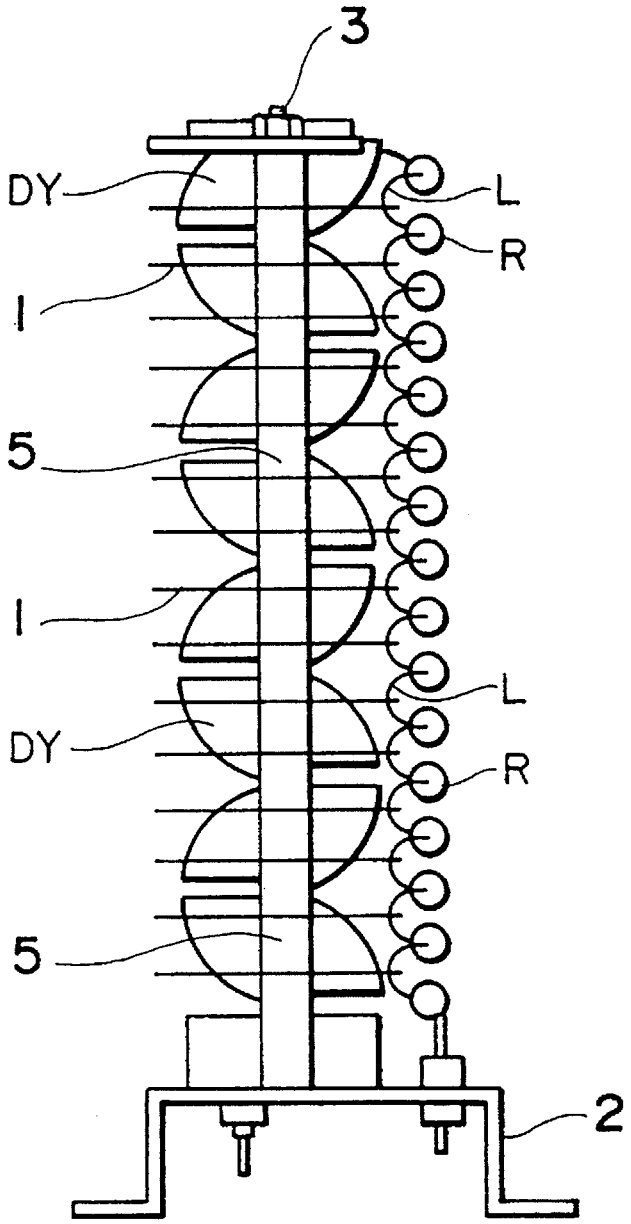
Fig. 2 (PRIOR ART)
FIG. 2 is a side view of a conventional electron multiplier.
Figure 3:
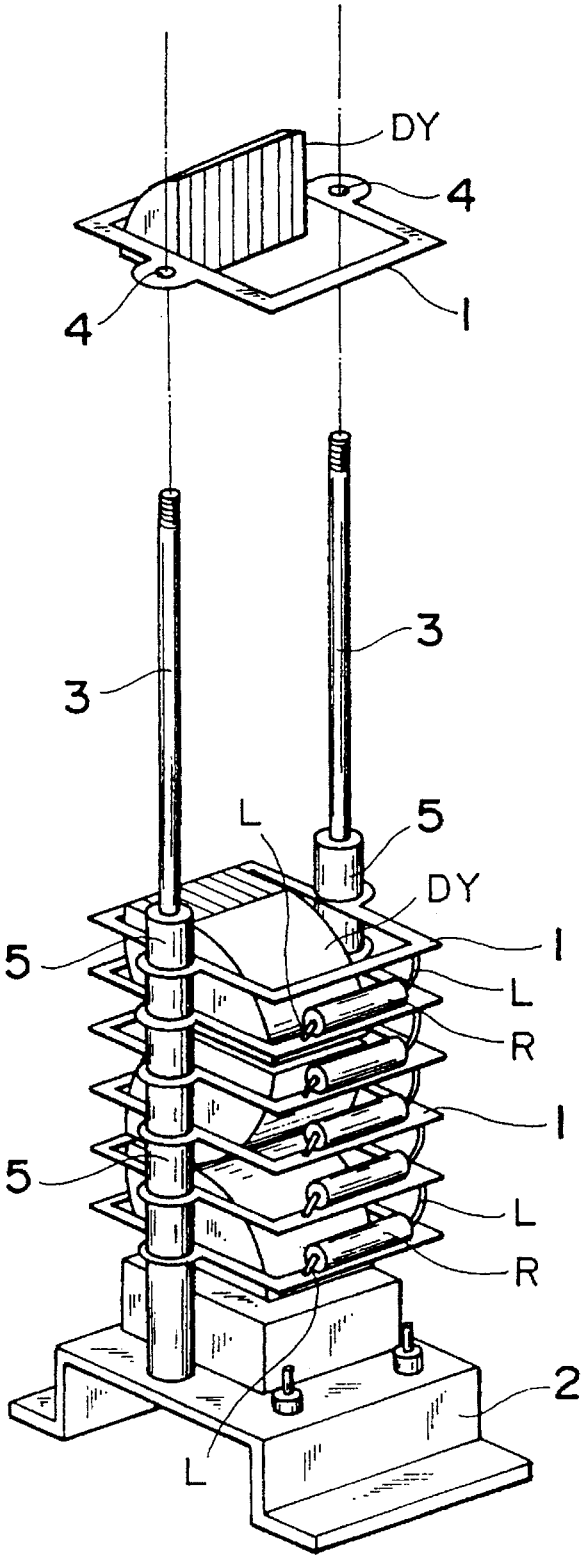
Fig. 3 (PRIOR ART)
FIG. 3 is a perspective view of the electron multiplier of FIG. 2 being assembled.

Embodiments of this invention will be explained in good detail with reference to the attached drawings hereto. In the attached FIGS., the common members are represented by common reference numerals. In the description of FIGS. 1 to 3, "vertically, or up to down", and "horizontally, or left to right" means "vertically, or up to down" and "horizontal, or left to right" as viewed in the attached FIGS..

Figure 4:
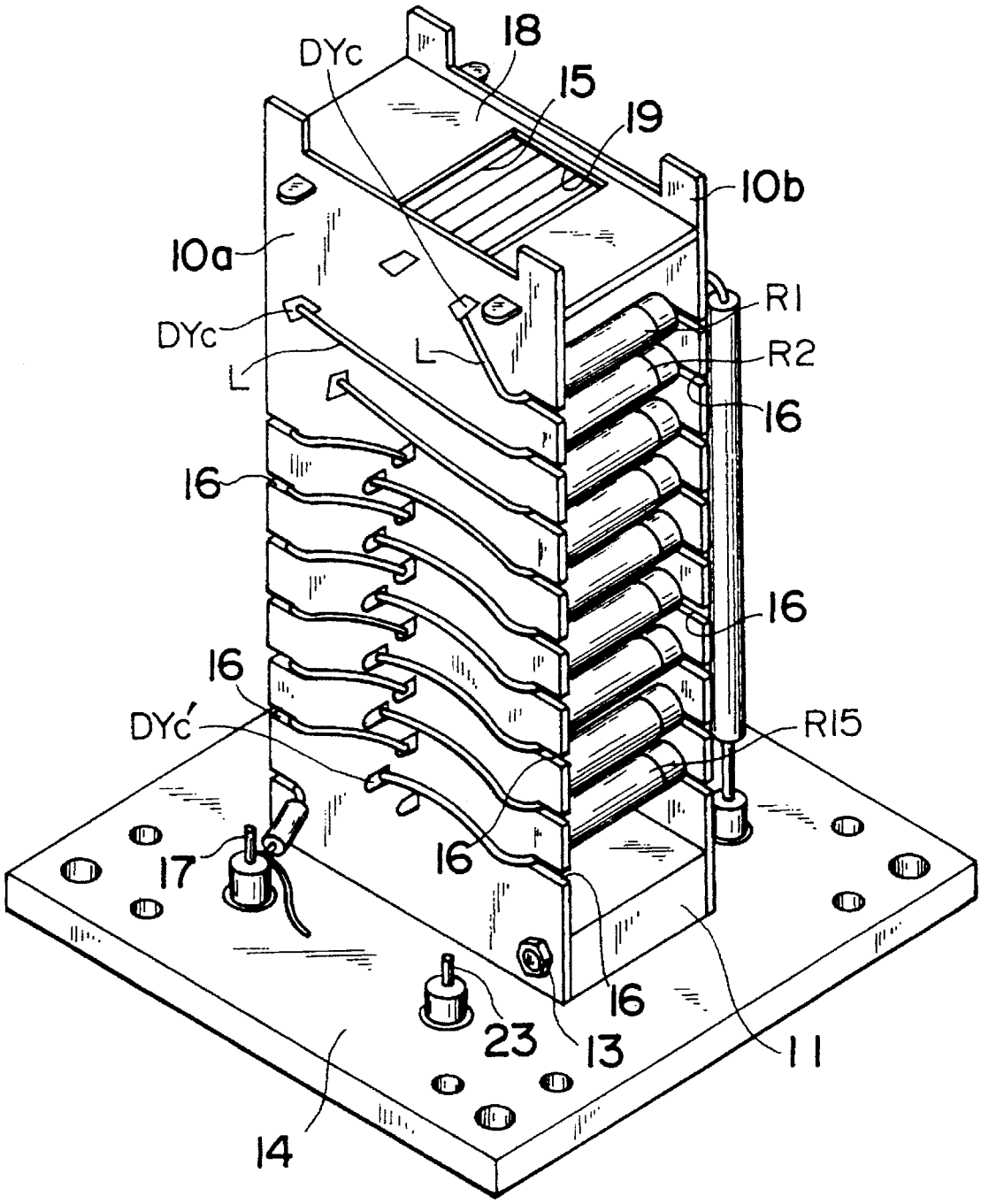
FIG. 4 is a perspective view of the electron multiplier according to one embodiment of this invention.
Figure 5:
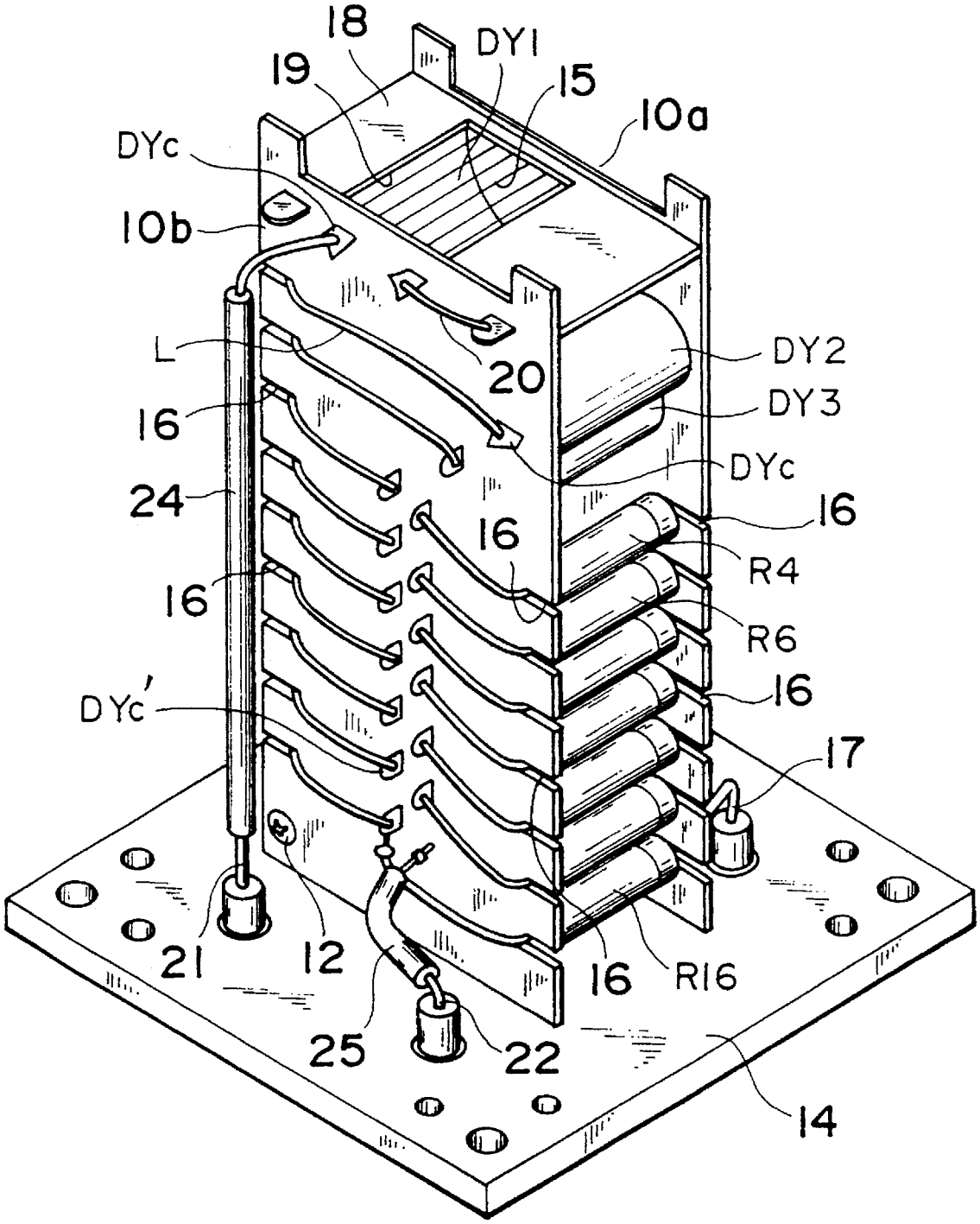
FIG. 5 is a perspective view of the electron multiplier of FIG. 4 as viewed at a different angle.
Figure 6:
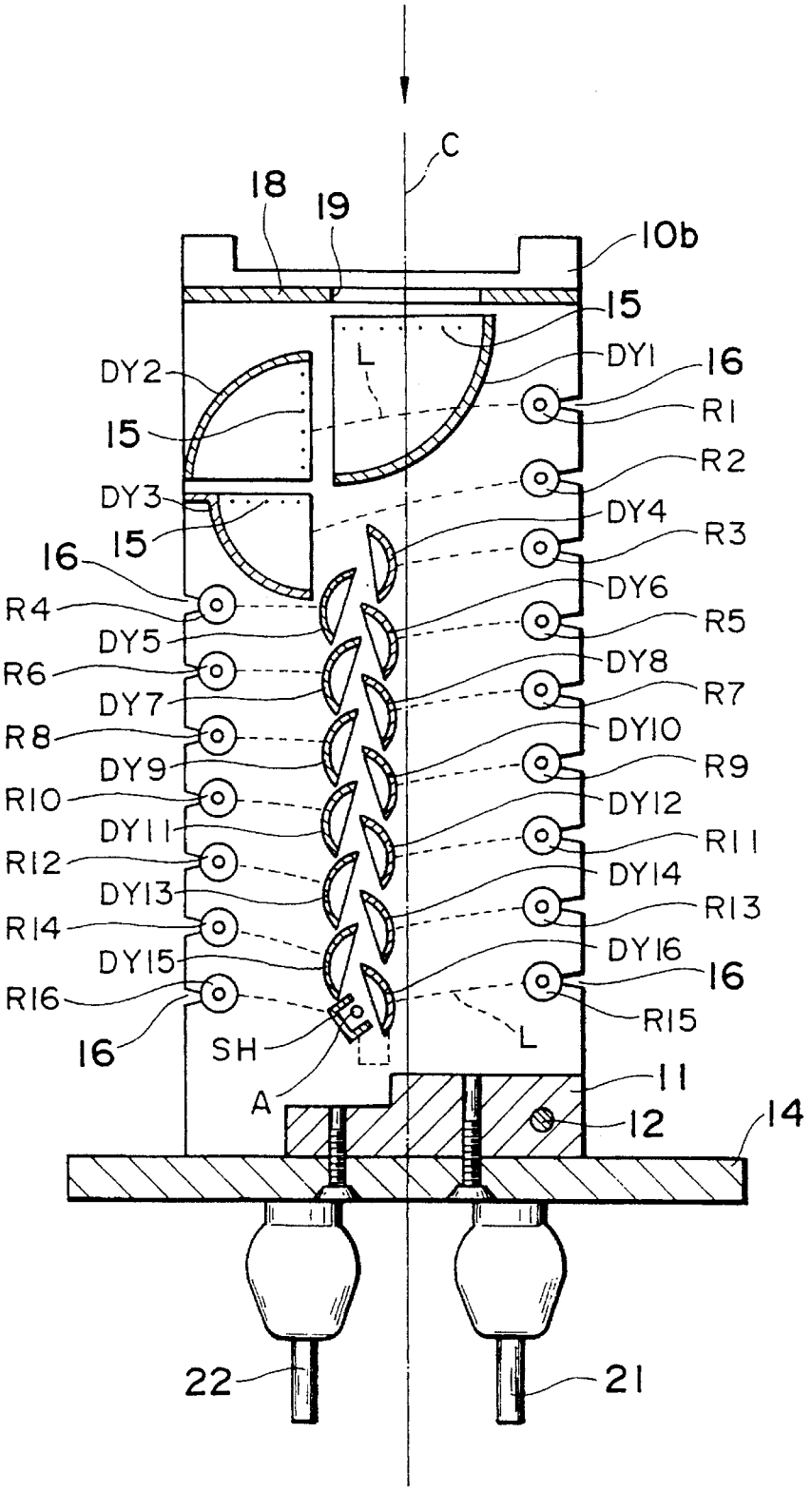
FIG. 6 is a longitudinal sectional view of the electron multiplier of FIG. 4.
Figure 9:
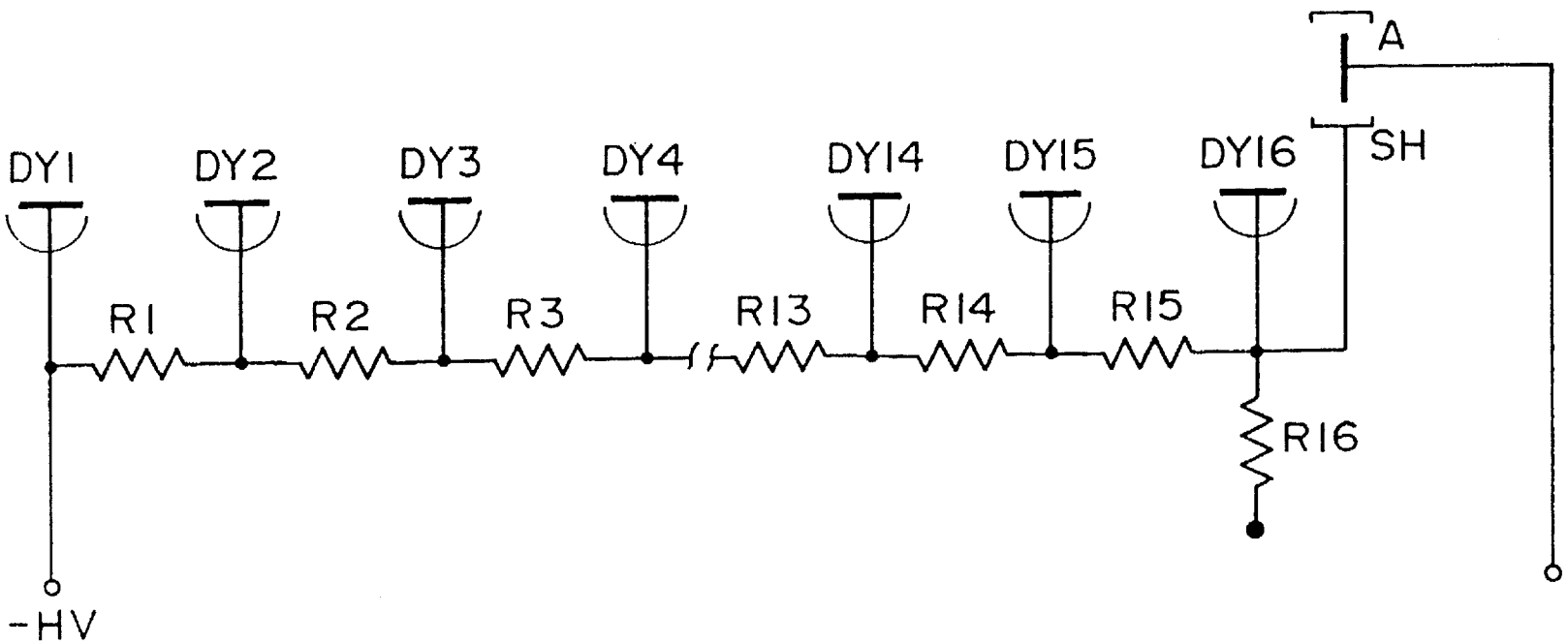
Fig. 9 (PRIOR ART)
FIG. 9 is a circuit diagram of a voltage dividing circuit used in the electron multiplier of FIG. 4.

As shown in FIGS. 4–6, the electron multiplier according to an embodiment of this invention comprises an ion multiplier having a plurality of stages (16 stages in this embodiment) of dynodes DY1~DY16 for capturing energy beams and emitting multiplied secondary electrons, a collecting electrode (anode) A for capturing electrons emitted from the final-stage DY16. A potential difference is provided between the respective dynodes and their adjacent ones so that the respective dynodes emit secondary electrons toward their lower-stage dynodes DY. To this end, the electron multiplier uses a voltage dividing circuit of FIG. 9. Resistors R1~R15 are inserted each between the respective resistors and their adjacent ones. A resistor R16 is inserted between the dynode DY16 and a terminal O which may be the earth or +HV, that terminal voltage being assumed as +HV for the remainder of this specification.

In this embodiment, the resistors R1–R16, the dynodes DY1~DY16, and the collecting anode A are mounted between support plates 10*a*, 10*b* of an insulating material, such as ceramics or others, which are arranged in parallel with each other. Each support plate 10*a*, 10*b* is substantially rectangular. A block 11 is secured to one end portion of the support plates 10*a*, 10*b* between the support plates 10*a*, 10*b* by bolts 12 and nuts 13. The block 11 is secured to the central portion of a substantially square base 14 of stainless steel by screws. The support plates 10*a*, 10*b* are thus secured to the base 14 in parallel with each other.

Figure 7:
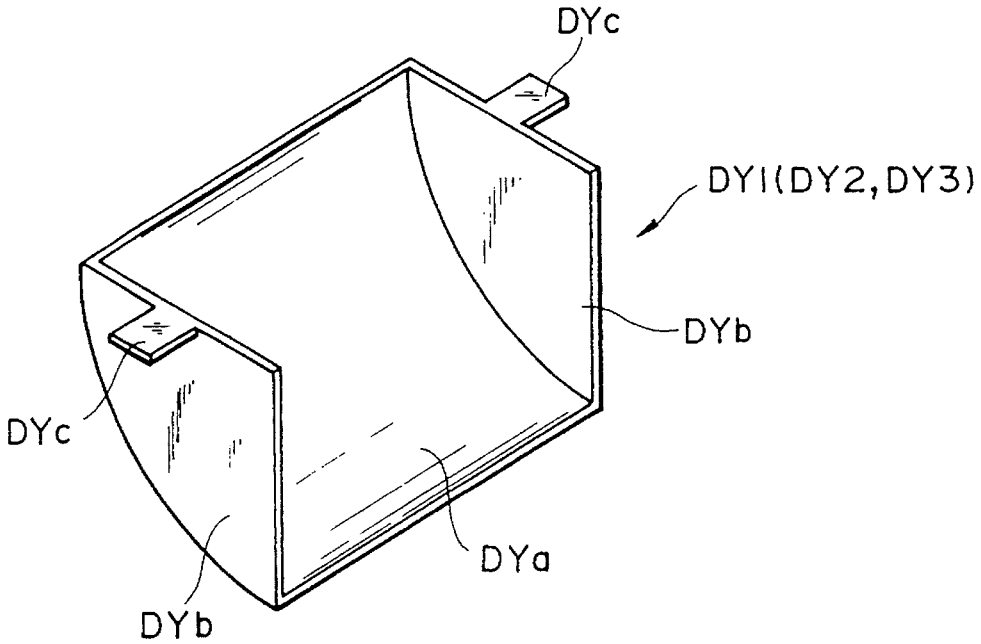
FIGS. 7 and 8 are, respectively a perspective view of the dynodes used in the electron multiplier of FIG. 4, FIG. 7 showing the first- to the third-stage dynodes, and FIG. 8 showing the fourth- to the sixteenth-stage dynodes.
Figure 8:
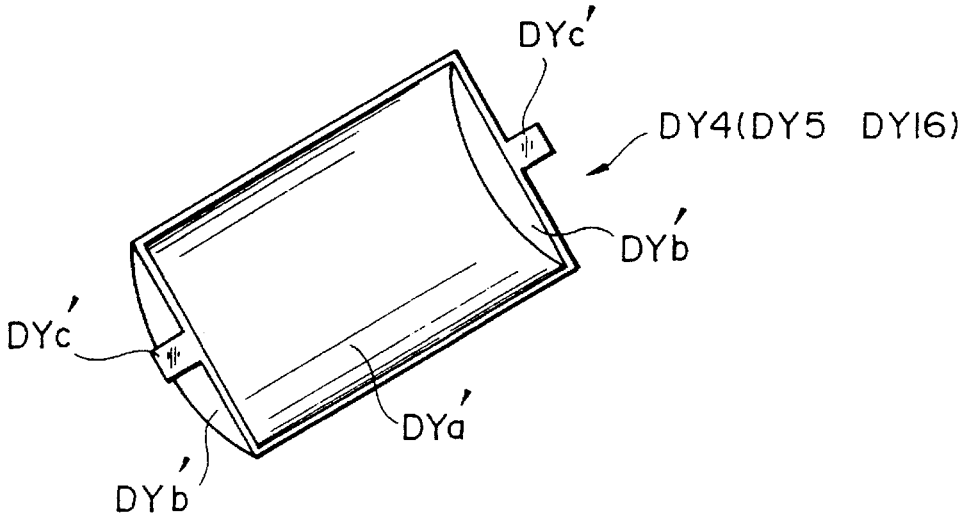

As shown in FIG. 7, the first- to the third-stage dynodes DY1~DY3, which are located on a upstream side in a flow of the multiplied secondary electron, have a one-piece structure of a quarter cylindrical portion DYa and secular end plate portions DYb. As shown in FIG. 8, the fourth-stage dynodes DY4 and the following dynodes DY5~DY16, which are located on a downstream side in the flow, have a one-piece structure of a one-eighth cylindrical portion DYa' as do the dynodes DY1~DY3, and arc-shaped end plate portions DYb'. In the inner surfaces of the one-eighth cylindrical portions DYa, DYa', a secondary electron emission surface formed of (CuBeO) is formed, and emit secondary electrons upon incidence of electrons or ions or energy beams. Each dynode has tabs DYc, DYc' projected from the end plate portions DYb, DYb' and bent. The tabs DYc, DYc' are inserted into slots formed in the support plates 10*a*, 10*b*, and the end portions of the tabs DYc, DYc' projected out of the slots are bent. Thus the dynodes DY1~DY16 are secured to set positions.

As shown in FIG. 6, the dynodes DY1~DY16 are arranged substantially alternately in the longitudinal direction of the support plates 10*a*, 10*b*. The relatively larger first- to the third-stage dynodes DY1~DY3, which are located in the upstream of the flow, are disposed in the so-called box-and grid-type arrangement. The other smaller dynodes DY4~DY16 are disposed in the so-called line focus-type or the linear focus-type arrangement. In this arrangement, energy beams enter along the longitudinal axis C of the support plates 10*a*, 10*b* and impinge on the quarter cylindrical portion DYa of the first-stage dynode DY1. A secondary electron emission takes place, and electrons are multiplied. The multiplied secondary electrons are led to the quarter cylindrical portion DYa of the second-stage dynode DY2. In this way, the secondary electrons are led subsequently to a next dynode to finally arrive at the final-stage dynode DY16, which is nearest to the base 14.

Reference numeral 15 represents mesh wires disposed on the entrance surface of the respective dynodes DY1~DY3. The mesh lines prevent the polarization of the electrons or the energy beams surely to lead without failure the secondary electrons to the concave surface of a next dynode DY.

The collecting electrode A is disposed at a position suitable to receive the electrons emitted from the final-stage dynode DY16. Both ends of the final-stage dynode are inserted in the slots to be positioned. The collecting electrode A is surrounded by a shield SH of U-shaped section mounted between the support plates 10*a*, 10*b*. The shield SH has the same potential as the final-stage dynode DY16 to prevent the entrance of noises into the collecting electrode A.

A plurality of recesses are formed in the longitudinal edges of each support plate 10*a*, 10*b*. In the two support plates 10*a*, 10*b* fixed to the base 14, the recesses 16 in the respective edges are on the same height as those 16 in their adjacent edges. Resistors R1~R16 of a voltage dividing circuit are mounted between the support plates 10*a*, 10*b* by means of the recesses 16. That is, each resistor is positioned between one pair of the recesses 16 on the same height with the leads inserted into the associated recesses 16, and are secured by bending the leads L toward the center of the support plates 10*a*, 10*b* and welding the forward ends of the leads to the forward ends of the tabs of the associated dynodes DY. Thus, the respective resistors R1~R16 are disposed horizontal on both sides of the gap between the support plates 10*a*, 10*b*. The resistors R1~R16 are arranged accordingly in the longitudinal direction and between the support plates 10*a*, 10*b* at a certain interval. In this embodiment, nine resistors R are disposed on a back side of diodes arranged in one row of two rows of arranged diodes, and seven resistors R are disposed on a back side of diodes arranged in the other row.

One of the leads L of the uppermost-stage resistor R1 is welded to one of the tabs DYc of the first-stage dynode DY1 on the support plate 10*a* (FIG. 4), and the other lead L is welded to the tab DYc of the second-stage dynode DY2 on the support plate 10*b* (FIG. 5). The other tab DYc of the second-stage dynode DY2 on the support plate 10*a* is connected to one lead L of the second-stage resistor R2 (FIG. 4). In this way, the leads of the resistors R are connected to the tabs DYc of the associated dynodes DY. The lowermost resistor R16 is inserted between the tab of the shield SH which (tab) is connected to one tab DYc of the lowermost-stage dynode DY16, and a hermetic terminal 17 on the side of the earth or +HV which is formed through the base 14.

In this embodiment, a metal plate 18 is mounted at the upper end of the gap between the support plates 10*a*, 10*b*. The metal plate 18 has an opening 19 formed at a position opposed to an entrance for energy beams. The metal plate 18 is connected to the first-stage dynode DY1 by a conductor 20 and is maintained at the same potential, so that the metal plate functions as a shield and also as a reinforcement of the electron multiplier assembly.

On the base 14 there are provided three hermetic terminals 21, 22, 23 in addition to the hermetic terminal 17 on the side of the earth or +HV. The terminal 21 is connected to the tab DYc of the first-stage dynode DY1 on the support plate 10*b* by a ceramic piped conductor 24. The terminal 22 is connected to the collecting electrode A by a ceramic piped conductor 25.

In this embodiment, the resistors R1~R16 are divided in two rows. In comparison with an electron multiplier with the resistors R1~R16 arranged in one row, a length of the electron multiplier according to this embodiment can be reduced to a half. The leads L of the resistors R1~R16 are held at the proximal ends by the support plates 10*a*, 10*b*, and the resistors R1~R16 do not substantially totter.

In the above-described embodiment, the resistors R are divided in two rows, one row including of 9 resistors, the other row including 7 resistors. But this invention is not limited to this embodiment. The arrangement of the dynodes and the stage number thereof are not limited to the described above types and stage number.

As described above, according to this invention, resistors in the voltage dividing circuit is arranged in two rows. Accordingly a total length of an electron multiplier restricted by the resistors can be reduced to substantially a half. The electron multiplier can be accordingly small-sized and can be installed at relatively small spaces.

Two sheets of plates hold resistors, dynodes and a collecting electrode therebetween. Accordingly the electron multiplier can have a strong structure and can be strong against impacts.

Furthermore, according to this invention, recesses are formed in the support plates, and leads of resistors are inserted in the recesses to position the resistors. Accordingly, the resistors can be positioned stationary, so that adjacent resistors are prohibited from interfering with each other, and adjacent leads are prohibited from interfering with each other. Stationary positioning of the resistors contributes to the improvement of noise characteristics. Such secured positioning of the resistors allows a gap between adjacent ones of the resistors to be reduced, so that a total length of an electron multiplier can be reduced.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An electron multiplier comprising:

a plurality of dynodes arranged in multiple stages, each dynode facing an adjacent dynode within the plurality of dynodes;

a voltage dividing circuit including a plurality of series connected resistors for applying a suitable potential to each of the dynodes, each of the resistors being electrically connected to an adjacent resistor within the plurality of resistors, the resistors being arranged in two rows on a back-side of the dynodes; and a pair of support plates formed of an insulating material, the support plates being arranged on opposing sides of each dynode and resistor, the support plates sandwiching and supporting the plurality of resistors and the plurality of dynodes.

2. An electron multiplier according to claim 1, wherein a dynode within the plurality of dynodes is located between each pair of electrically connected resistors respectively.

3. An electron multiplier according to claim 1, wherein the plurality of resistors respectively correspond to the plurality of dynodes, each of the resistors being located along a back side of the corresponding dynode.

4. An electron multiplier according to claim 1, wherein the support plates have recesses extending toward a center from an edge, each of the recesses being located where each resistor is supported, each resistor being fixed to the pair of support plates through a pair of leads which extend from the sides of the resistor, the leads being used to electrically connect the resistors.

5. An electron multiplier according to claim 1, wherein dynodes within the plurality of dynodes which are located on an upstream side in a flow of multiplied secondary electrons are arranged in a box-and-grid arrangement, and dynodes within the plurality of dynodes which are located on a downstream side in the flow of multiplied secondary electrons are arranged in one of a line-focus arrangement or a linear-focus arrangement.

6. An electron multiplier according to claim 1, wherein tab members are formed on edges of each of the dynodes, and slots are formed in each of the support plates for receiving the tab members, each of the slots being positioned based on a location of each of the dynodes, whereby each of the dynodes is fixed to the pair of support plates by inserting the respective tab members into a corresponding slot in the pair of support plates.

7. An electron multiplier according to claim 1, wherein each of the support plates has slots for supporting the dynodes, the slots being arranged along an arrangement direction of the dynodes, and wherein each of the support plates further has recesses for supporting the plurality of resistors, the recesses being arranged at edge portions of each support plate, the recesses in one plate being arranged in parallel with the recesses in the other plate along the arrangement direction of the dynodes.

8. An electron multiplier comprising:

a plurality of dynodes arranged in multi-stages, each dynode facing an adjacent dynode within the plurality of dynodes;

a voltage dividing circuit including a plurality of series connected resistors for applying a suitable potential to each of the dynodes, each of the resistors being electrically connected to an adjacent resistor within the plurality of resistors; and a pair of support plates formed of an insulating material, the support plates being arranged on opposing sides of each dynode and resistor, the support plates sandwiching and supporting the plurality of resistors and the plurality of dynodes, wherein each of the support plates has first holders for holding one end of the dynodes and second holders for holding one end of the resistors, the first holders being arranged along an arrangement direction of the dynodes and the second holders being arranged in two rows along the arrangement direction of the dynodes, the second holders being aligned at outer edge portions of each support plate, the outer edge portions being located in parallel with respect to the arrangement direction of the dynodes.

9. An electron multiplier according to claim 8, wherein the first holders are slits formed at a main surface of each support plate, and the second holders are recesses formed at the outer edge portions of each support plate.

* * * * *